US007038155B2

(12) United States Patent
Ahlert et al.

(10) Patent No.: US 7,038,155 B2
(45) Date of Patent: May 2, 2006

(54) LATCHING MECHANISM FOR LOCKING AN ACTUATING SHAFT AND ELECTRICAL SWITCH WITH A LATCHING MECHANISM OF THIS TYPE

(75) Inventors: Torsten Ahlert, Fuerstenwalde (DE); Joerg-Uwe Dahl, Werder (DE); Marc Liebetruth, Glienicke (DE)

(73) Assignee: Siemens Aktiengesellschaft, Munich (DE)

( * ) Notice: Subject to any disclaimer, the term of this patent is extended or adjusted under 35 U.S.C. 154(b) by 153 days.

(21) Appl. No.: 10/834,901

(22) Filed: Apr. 30, 2004

(65) Prior Publication Data

US 2004/0263294 A1 Dec. 30, 2004

(30) Foreign Application Priority Data

Apr. 30, 2003 (DE) ..... 103 20 681

(51) Int. Cl.
*H01H 5/00* (2006.01)

(52) U.S. Cl. ..... 200/400; 200/401; 335/172

(58) Field of Classification Search ..... 200/400–401, 200/244, 303, 564; 335/15–16, 172, 195
See application file for complete search history.

(56) References Cited

U.S. PATENT DOCUMENTS 5,290,982 A * 3/1994 Beck et al. ..... 200/401
5,543,595 A * 8/1996 Mader et al. ..... 200/401
5,772,009 A * 6/1998 Rogers et al. ..... 200/400
6,018,284 A 1/2000 Rival et al.
6,222,143 B1 * 4/2001 Lawson et al. ..... 200/401
6,437,670 B1 * 8/2002 Castonguay et al. ..... 335/6
6,507,256 B1 * 1/2003 Castonguay et al. ..... 335/172

* cited by examiner

*Primary Examiner*—Kyung Lee
(74) *Attorney, Agent, or Firm*—Harness, Dickey & Pierce P.L.C.

(57) ABSTRACT

A latching mechanism is for locking an actuating shaft of an electrical switch, which can be transferred from an OFF position into an ON position by a drive train counter to the force of at least one first spring, in its ON position. The latching mechanism includes a first lever, which is pivotably coupled to the drive train of the actuating shaft and is supported against a stop held in a locking position. For accelerated release of the actuating shaft, also provided is a second lever, which has a working surface assigned to the stop. In this case, the second lever is held in a first stop position against the first lever by way of a second spring. When the second lever pivots under the action of an initiating force, which opposes the force of the second spring, the working surface acts in such a way on the stop that the stop is transferred into a release position. In order to release the actuating shaft more quickly, the forces of the two springs act independently of one another on the first lever, so that a mechanism which provides the initiating force can be formed independently of the drive train.

14 Claims, 2 Drawing Sheets

LATCHING MECHANISM FOR LOCKING AN ACTUATING SHAFT AND ELECTRICAL SWITCH WITH A LATCHING MECHANISM OF THIS TYPE

The present application hereby claims priority under 35 U.S.C. §119 on German patent application number DE 103 20 681.7 filed Apr. 30, 2003, the entire contents of which are hereby incorporated herein by reference.

FIELD OF THE INVENTION

The invention generally lies in the field of electrical switches which are equipped with an actuating shaft coupled to a drive for moving at least one movable contact. These can be used, for example, for the structural design of a latching mechanism for locking the actuating shaft.

BACKGROUND OF THE INVENTION

A known electrical switch, in which the actuating shaft can be transferred from an OFF position into an ON position by use of a drive train counter to the force of at least one spring, has a latching mechanism in which a first lever pivotably coupled to the drive train is supported against a stop held in a locking position. For transferring the stop into a release position, in which the first lever relinquishes its support against the stop, two triggering operations are provided. Consequently, the transfer of the stop into its release position can take place on the one hand by means of a "normal" triggering operation, in which the stop is actuated directly.

On the other hand, the latching mechanism is provided with a second lever, which has a working surface assigned to the stop. The second lever is in this case held in a first stop position against the first lever by means of at least one second spring. When the second lever pivots under the action of an initiating force, which opposes the force of the second spring, the working surface acts in such a way on the stop that the stop is transferred into its release position—in the course of a triggering operation that is "accelerated" with respect to the "normal" triggering operation (U.S. Pat. No. 6,018,284).

In the case of this known latching mechanism, the second lever and two of the second springs serve not only for the pivoting of the stop but also for the coupling of the drive train to the first lever. The force of the first spring therefore acts indirectly via the second lever and the second springs on the first lever. The force of the first spring acts, as it were, in series with the force of the second spring on the first lever. The dual function of the second lever and of the second spring has the effect on the one hand that the pivoting of the second lever, and consequently the "accelerated" triggering operation, is dependent on the sequence of movements of the drive train and on the other hand that the "normal" triggering operation is dependent on the configuration of the second lever and of the second springs.

SUMMARY OF THE INVENTION

It is the object of an embodiment of the invention to make an "accelerated" triggering operation, that is brought about by pivoting of the second lever, even faster.

According to an embodiment of the invention, an object may be achieved by the forces of the two springs acting independently of one another on the first lever.

On the basis of a design of this type, the second spring does not serve for the coupling of the first lever to the drive train. The force of the second spring in this case acts as if it were not in series with, but parallel to, the force of the first spring on the first lever.

This configuration has an advantage that, for providing the initiating force for pivoting the first lever, it is possible to choose an initiating device or an initiating mechanism which "skips" transmission links of the drive train or of the coupling of the drive train to the first lever in such a way that the second lever pivots more quickly than in the case of a known latching mechanism, for example known from the publication U.S. Pat. No. 6,018,284. This configuration also has the advantage that the "normal" triggering operation, brought about by actuating the stop by way of a triggering train, substantially does not depend on the configuration of the second lever and the configuration of the second spring.

It is advantageously provided in the case of a further configuration of an embodiment of the invention that the second lever is pivotably mounted on the first lever and the path of movement of the second lever is limited by two stop surfaces of the first lever. In the case of a configuration of this type, the sequence of movements of the second lever is determined only by the structural design of the first lever and by the initiating force, but not by further parts of the drive train or of the coupling of the drive train to the first lever. The second lever can therefore be combined with the first lever to form a structural unit, forming a self-contained system in terms of forces, even before the latching mechanism is assembled.

In the first stop position, the force of the second spring therefore does not influence the force with which the first lever bears against the stop. This allows a smaller tolerance range for the force under which the first lever bears against the stop and a smaller tolerance range of the triggering force of the "normal" triggering operation to be provided. Known latching mechanisms of the generic type can be structurally converted in a simple way according to an embodiment of the invention.

For example, the initiating force of a magnetic trigger or the force of a spring store may serve for the pivoting of the second lever.

To be able to pivot the second lever as quickly as possible, it is advantageous if the pivot axes of the two levers are arranged at a distance from one another.

BRIEF DESCRIPTION OF THE DRAWINGS

The present invention will become more fully understood from the detailed description of preferred embodiments given hereinbelow and the accompanying drawing, which is given by way of illustration only and thus are not limitative of the present invention, and wherein.

DETAILED DESCRIPTION OF THE PREFERRED EMBODIMENTS

Figure 1:
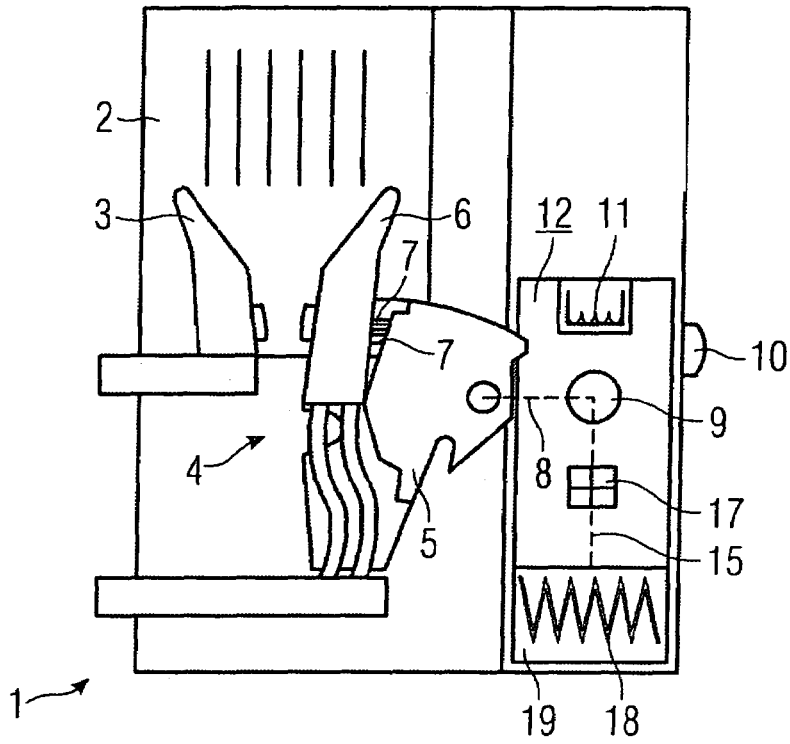
FIG. 1 shows a schematic representation of an electrical switch with a latching mechanism.

FIG. 1 shows an electrical switch 1 in the form of a low-voltage circuit breaker with a switching contact system and an assigned arcing chamber 2. The switching contact system includes a fixed switching contact arrangement 3 and a movable switching contact arrangement 4.

The movable switching contact arrangement 4 has in this case a pivotable contact carrier 5 and a number of contact levers 6, the contact levers 6 being pivotable parallel to one another and resiliently supported on the contact carrier 5 under prestressing by means of first springs 7. The movable switching contact arrangement 4 is coupled to an actuating shaft 9 in a known way by way of a lever arrangement 8 that is only schematically indicated in FIG. 1 (cf. also FIG. 2). The actuating shaft 9 serves at the same time for driving further switching contact systems (not represented any further), arranged parallel to the switching contact system shown. It can be transferred by means of a drive device 12 from an OFF position, in which the switching contact system is open, into an ON position, in which the switching contact system is closed.

When the actuating shaft 9 is being transferred into its ON position, the first springs 7 are stressed further, so that the force of the first springs 7 acts in the pivoting direction 13 of the actuating shaft 9 pointing toward the OFF position. The drive device 12 has a drive 19, which is provided with a spring store 18, a drive train 15, which couples the drive 19 to the actuating shaft 9, and a latching mechanism 17. The latching mechanism 17 has in a known way two locking devices, of which a first serves for the locking of the stressed spring store 18 and the second serves for the locking of the actuating shaft 9, transferred into its ON position counter to the force of the first springs 7.

Figure 2:
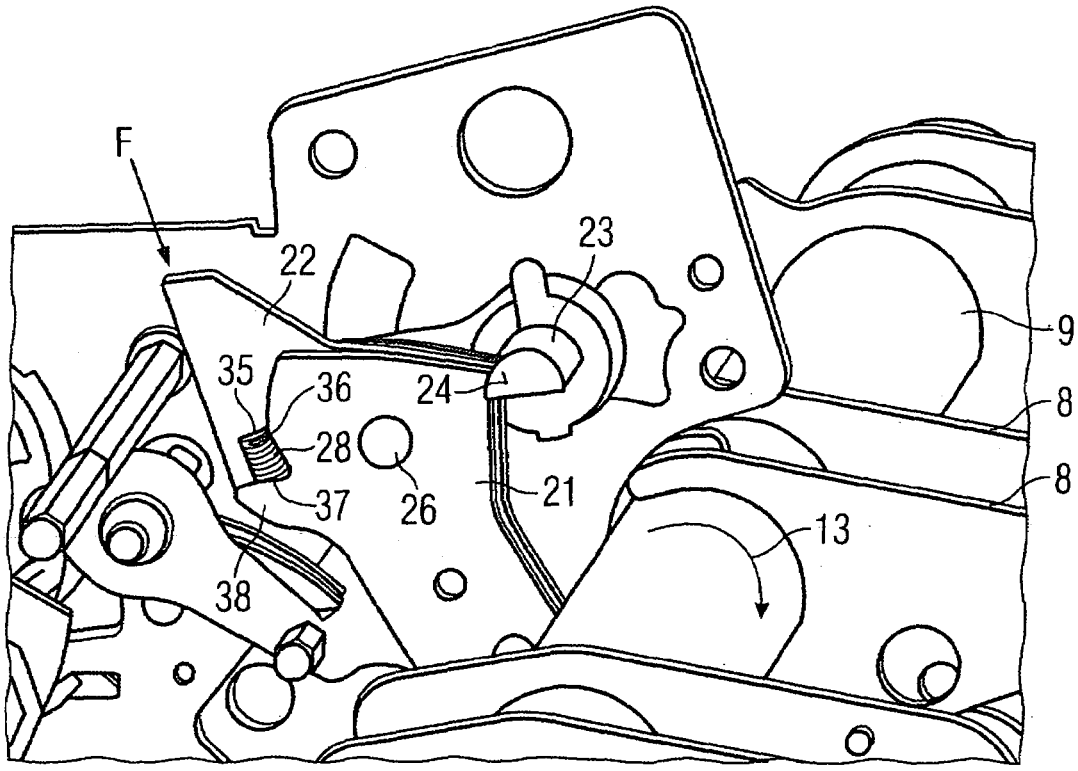
FIG. 2 shows a perspective view of the latching mechanism in a first stop position.

According to FIG. 2, the second locking device of the latching mechanism has a first lever 21, which is coupled to the drive train 15, a second lever 22 and a stop 23, which is formed as a half-shaft. The first lever 21 includes two part-levers, which are arranged parallel to and at a distance from one another, and is pivotable about a first pivot bearing 25, which is held fixed in place on a carrying device 14 for the drive device 12. The first lever bears against the stop 23 with a locking surface 24 under the force of the first springs 7 when the actuating shaft 9 is in the locked ON position.

In the case of a "normal" triggering operation, actuation of the stop 23 takes place via a triggering train (not represented), for example manually by means of a pushbutton 10 arranged on the front side of the switch or by an electromagnet 11. The second lever 22 is pivotable about a second pivot bearing 26, the second pivot bearing 26 being formed by a bolt which is held at its ends by the two part-levers of the first lever 21.

In order to hold the second lever 22 in a stop position against the first lever 21, there is provided on the one hand a second spring 28, which is arranged as a relative spring between the two levers 21 and 22, and on the other hand a pin-slot connection. In this case, a pin 29 formed on the first lever 21 engages in a slot 30 formed in the second lever, the two ends of the slot respectively forming a stop surface 31 and 32 for the pin 29. The one end 35 of the second spring 28 reaches over a lug 36 of the second lever 22. The other end 37 of the second spring 28 is supported on projections 38 of the part-levers of the first lever 21.

Figure 3:
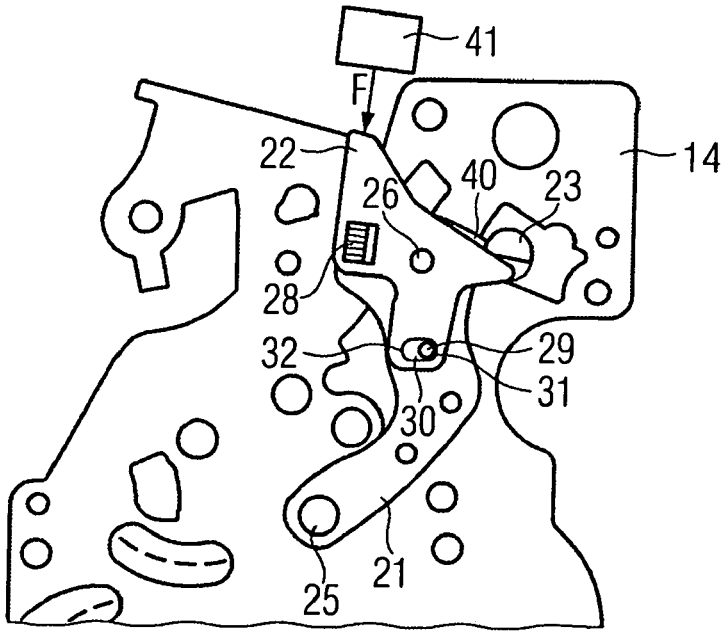
FIG. 3 shows the view according to FIG. 2 in a sectional representation and FIG. 4 shows a sectional representation of the latching mechanism in a second stop position.

According to FIG. 3, in the case of the first stop position of the second lever 22 against the first lever 21, a first of the two stop surfaces 31 of the slot 30 bears against the pin 29 under the force of the second spring 28. In this case, a ramp-like working surface 40 of the second lever 22 is located underneath the stop 23 formed as a half-shaft, without influencing the latter in terms of force. In the case of a short-circuit, an initiating device 41 formed as a fast magnetic trigger acts with an initiating force F directly on an actuating surface of the second lever. The initiating force F may, however, also be provided by other initiating means or mechanisms, for example by a spring store.

Figure 4:
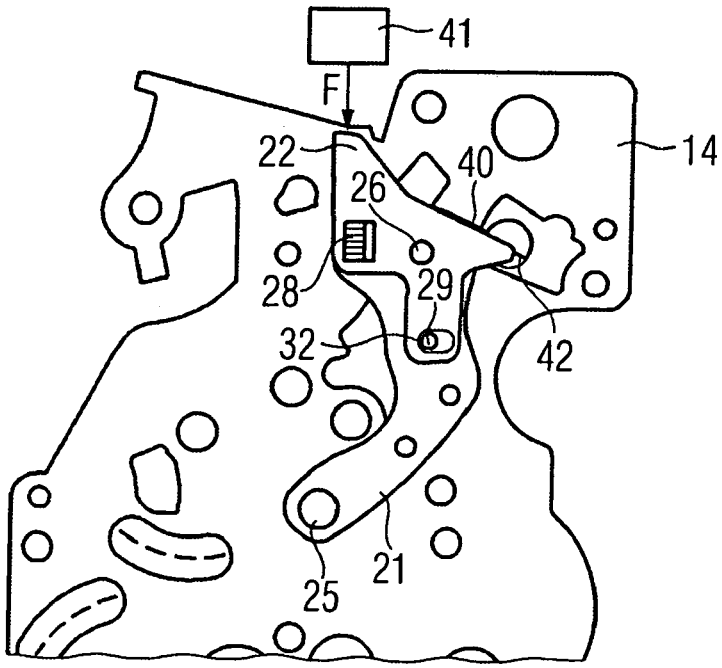

According to FIG. 4, the second lever 22 is pivoted counterclockwise under the initiating force F of the initiating device 41, counter to the force of the second spring 28, in such a way that its ramp-like working surface 40 slides along the flat underside 42 of the half-shaft and thereby turns the half-shaft clockwise and transfers it into its release position. In the release position of the half-shaft, the first lever 21, the drive train 15 and the actuating shaft 9 relinquish their support against the half-shaft, and the actuating shaft 9 is transferred under the force of the first springs 7 into its OFF position. Once the first lever 21 has relinquished its support against the half-shaft and begins to pivot through under the half-shaft, the initiating force F and the force of the second spring 28 also contribute to the acceleration of the first lever 21, so that the actuating shaft 9 arrives very quickly in its OFF position.

Depending on the directions of action of the force of the second spring 28 and of the initiating force F with respect to the pivot bearing 25 of the first lever 21 and depending on the value of the force of the second spring 28 and the position of the second stop surface 32, the moment accelerating the first lever 21 can be controlled.

Exemplary embodiments being thus described, it will be obvious that the same may be varied in many ways. Such variations are not to be regarded as a departure from the spirit and scope of the present invention, and all such modifications as would be obvious to one skilled in the art are intended to be included within the scope of the following claims.

What is claimed is:

1. A latching mechanism for locking an actuating shaft of an electrical switch, transferrable from an OFF position into an ON position via a drive train counter to the force of at least one first spring, in its ON position, the latching mechanism comprising:

a first lever, pivotably coupled to the drive train, supported against a stop held in a locking position; and a second lever, including a working surface assigned to the stop, the second lever being held in a stop position against the first lever by at least one second spring, wherein when the second lever pivots under the action of an initiating force which opposes the force of the second spring, the working surface acts in such a way on the stop that the stop is transferred into a release position, and wherein the forces of the at least two springs act independently of one another on the first lever.

2. The latching mechanism as claimed in claim 1, wherein the second lever is pivotably mounted on the first lever and wherein the path of movement of the second lever is limited by two stop surfaces of the first lever.

3. The latching mechanism as claimed in claim 2, wherein the force of a magnetic trigger serves for the pivoting of the second lever.

4. The latching mechanism as claimed in claim 2, wherein the force of a spring store serves for the pivoting of the second lever.

5. The latching mechanism as claimed in claim 2, wherein the pivot axes of the two levers are arranged at a distance from one another.

6. The latching mechanism as claimed in claim 1, wherein the force of a magnetic trigger serves for the pivoting of the second lever.

7. The latching mechanism as claimed in claim 6, wherein the pivot axes of the two levers are arranged at a distance from one another.

8. The latching mechanism as claimed in claim 1, wherein the force of a spring store serves for the pivoting of the second lever.

9. The latching mechanism as claimed in claim 8, wherein the pivot axes of the two levers are arranged at a distance from one another.

10. The latching mechanism as claimed in claim 1, wherein the pivot axes of the two levers are arranged at a distance from one another.

11. An electrical switch, comprising:

an actuating shaft for moving at least one movable switching contact arrangement;

a drive; and a drive train coupling the drive to the actuating shaft, wherein a latching mechanism as claimed in claim 1 is provided for locking the actuating shaft.

12. The electrical switch of claim 3, wherein the electrical switch is a low-voltage circuit breaker.

13. An electrical switch, comprising the latching mechanism of claim 1.

14. An electrical switch, transferrable from an OFF position into an ON position via the drive train counter to the force of at least one first spring, comprising:

an actuating shaft, adapted to move at least one movable switching contact arrangement;

a drive train, coupling a drive to the actuating shaft; and a latching mechanism, adapted to lock the actuating shaft, the latching mechanism including, a first lever, pivotably coupled to the drive train, supported against a stop held in a locking position; and a second lever, including a working surface assigned to the stop, the second lever being held in a stop position against the first lever by at least one second spring, wherein when the second lever pivots based upon a force opposing a force of the second spring, the working surface acts to transfer the stop into a release position, and wherein the forces of the at least two springs act independently of one another on the first lever.

* * * * *